US006109967A

United States Patent [19]

Chiou

[11] Patent Number: 6,109,967

[45] Date of Patent: Aug. 29, 2000

[54] ELECTRICAL CONNECTOR WITH SHIELD

[75] Inventor: Song-Rong Chiou, Lin-Kou, Taiwan

[73] Assignee: Hon Hai Precision Ind. Co., Ltd., Taipei Hsien, Taiwan

[21] Appl. No.: 09/304,117

[22] Filed: May 3, 1999

[30] Foreign Application Priority Data

Jul. 4, 1998 [TW] Taiwan ..... 87210763

[51] Int. Cl.[7] ..... H01R 13/648

[52] U.S. Cl. ..... 439/607

[58] Field of Search ..... 439/607, 609, 439/108

[56] References Cited

U.S. PATENT DOCUMENTS 5,083,945 1/1992 Miskin et al. ..... 439/607
5,207,597 5/1993 Kline et al. ..... 439/607
5,378,172 1/1995 Roberts ..... 439/607
5,797,770 8/1998 Davis et al. ..... 439/607
5,984,725 11/1999 Belopolsky et al. ..... 439/607
5,984,726 11/1999 Wu ..... 439/607

*Primary Examiner*—T. C. Patel
*Attorney, Agent, or Firm*—Wei Te Chung

[57] ABSTRACT

An electrical connector comprises an insulative housing, a number of contacts, and a conductive shield enclosing the housing. The housing defines a number of passageways for receiving the contacts with terminal portions outwardly extending. The shield is integrally formed by means of stamping wherein a mating portion is further formed thereon by a drawing process. A fastening section fastens the shield and the mating portion together thereby defining a cavity for receiving the housing. By bending a rear wall of the shield the housing can be entirely enshrouded by the shield thereby providing excellent shielding capabilities.

10 Claims, 7 Drawing Sheets

ELECTRICAL CONNECTOR WITH SHIELD

BACKGROUND OF THE INVENTION

The present invention relates to an electrical connector, and, more particularly to an electrical connector having a conductive shield by stamping.

Conventional electrical connectors with conductive shields are generally used for transmitting signals of high speed and high frequency, and other electrical connectors without conductive shields are comparatively used for transmitting signals of low speed and low frequency. Most electrical connectors with conductive shields, especially miniature connectors enclose two separate shields. One of the shields surrounds an insulative housing and the other shield forms a mating portion by a drawing process.

The mating portion of a miniature electrical connector must be drawn due to restrictions of the space thereof. However, the drawn miniature metal plates easily results in a significant waste of material and a deformation of corners thereof. Thus, such electrical connectors must be assembled with two separate shields, which complicates both manufacture and assembly. Therefore, an improvement in conductive shield design is necessary to simplify the manufacturing process and decrease production costs.

BRIEF SUMMARY OF THE INVENTION

Accordingly, an object of the present invention is to provide an electrical connector having a shielding housing integrally formed by stamping thereby simplifying assembly and decreasing manufacturing costs.

To fulfill the object mentioned above, an electrical connector comprises an insulative housing, a number of contacts, and a conductive shield enclosing the housing. The housing defines a plurality of passageways for receiving therein the contacts with terminal portions outwardly extending. The shield is integrally formed by means of stamping wherein a mating portion is formed thereon by a drawing process. A fastening section fastens the shield and the mating portion together thereby defining a cavity for receiving the housing therein. By bending a rear wall of the shield the housing can be entirely enshrouded by the shield in an excellent shielding capabilities.

Other objects, advantages and novel features of the invention will become more apparent from the following detailed description when taken in conjunction with the accompanying drawings.

DETAILED DESCRIPTION OF THE INVENTION

Figure 1:
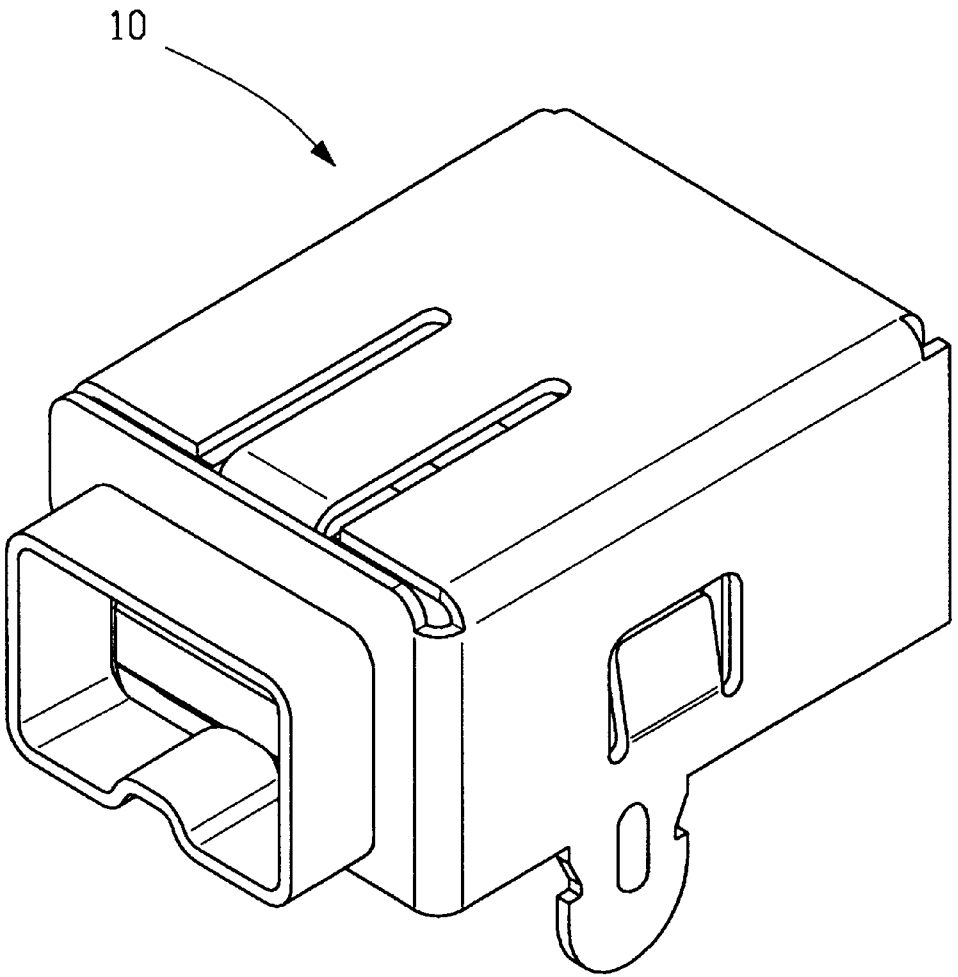
FIG. 1 is a perspective view of a shielded electrical connector in accordance with the present invention.
Figure 2:
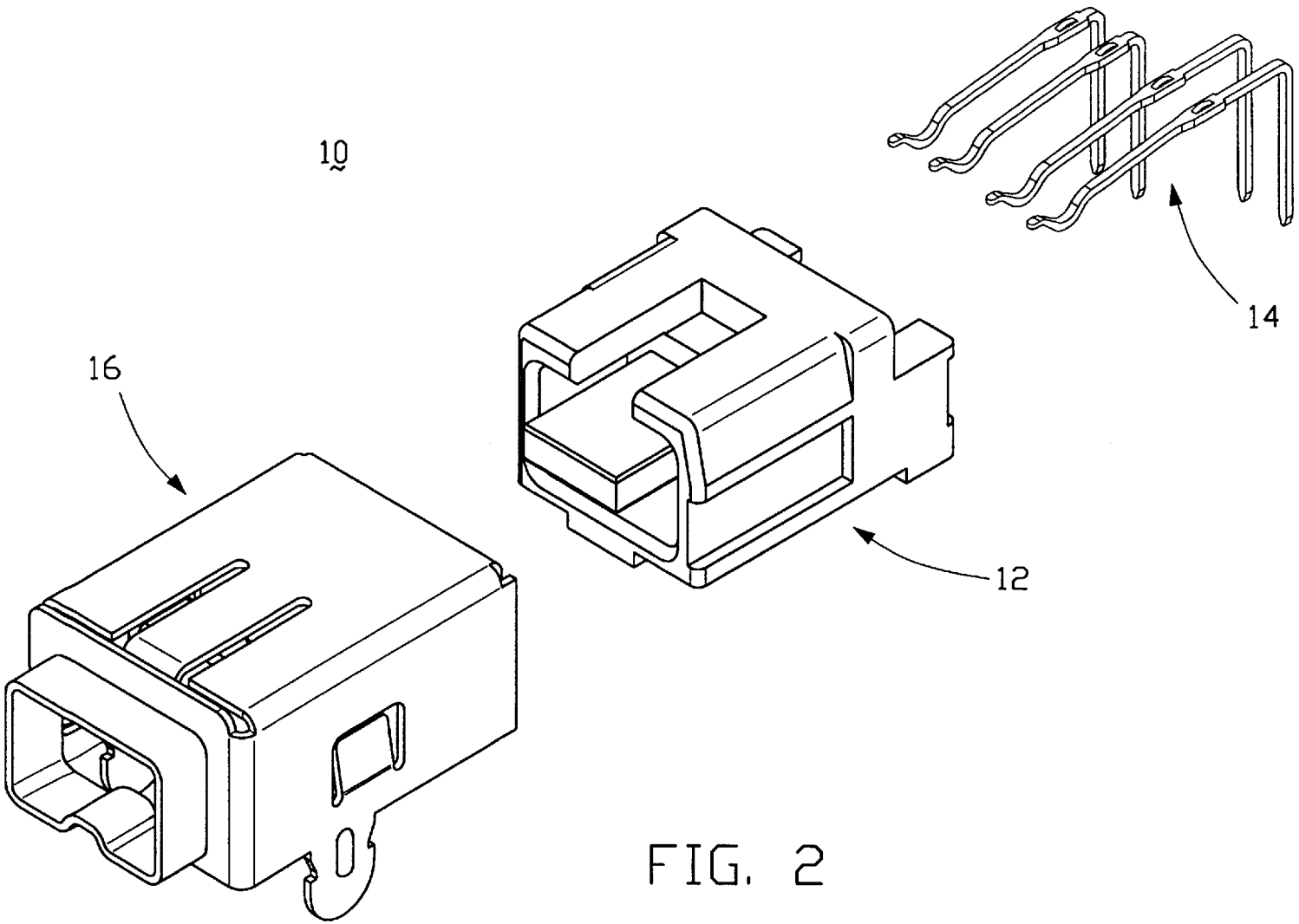
FIG. 2 is an exploded view of FIG. 1.

Referring to FIGS. 1 and 2, a shielded electrical connector 10 in accordance with the present invention, comprises an insulative housing 12, a number of contacts 14, and a conductive shield 16 enclosing the insulative housing 12. The housing 12 defines a plurality of passageways (not labeled) for receiving the corresponding contacts 14 therein.

Figure 3:
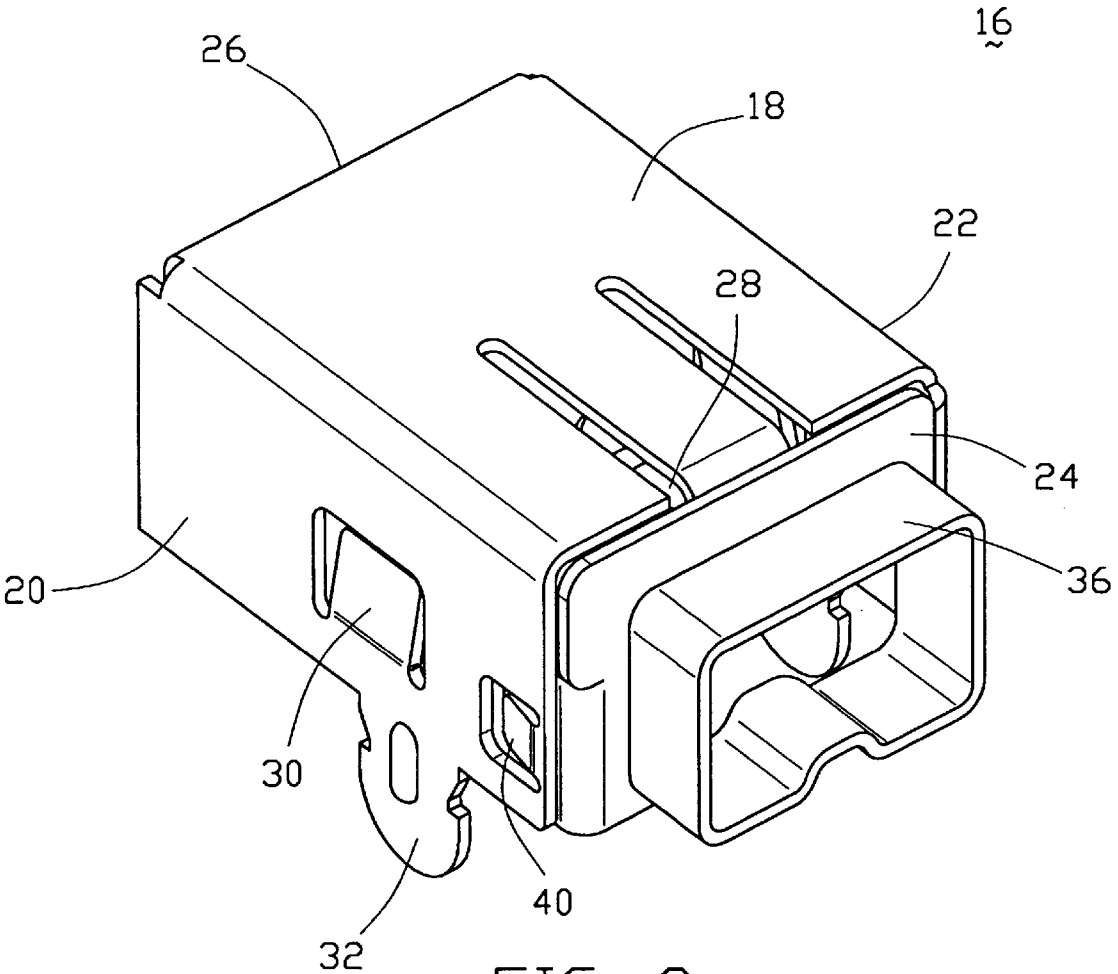
FIG. 3 is a perspective view of a conductive shield in accordance with the present invention.
Figure 4:
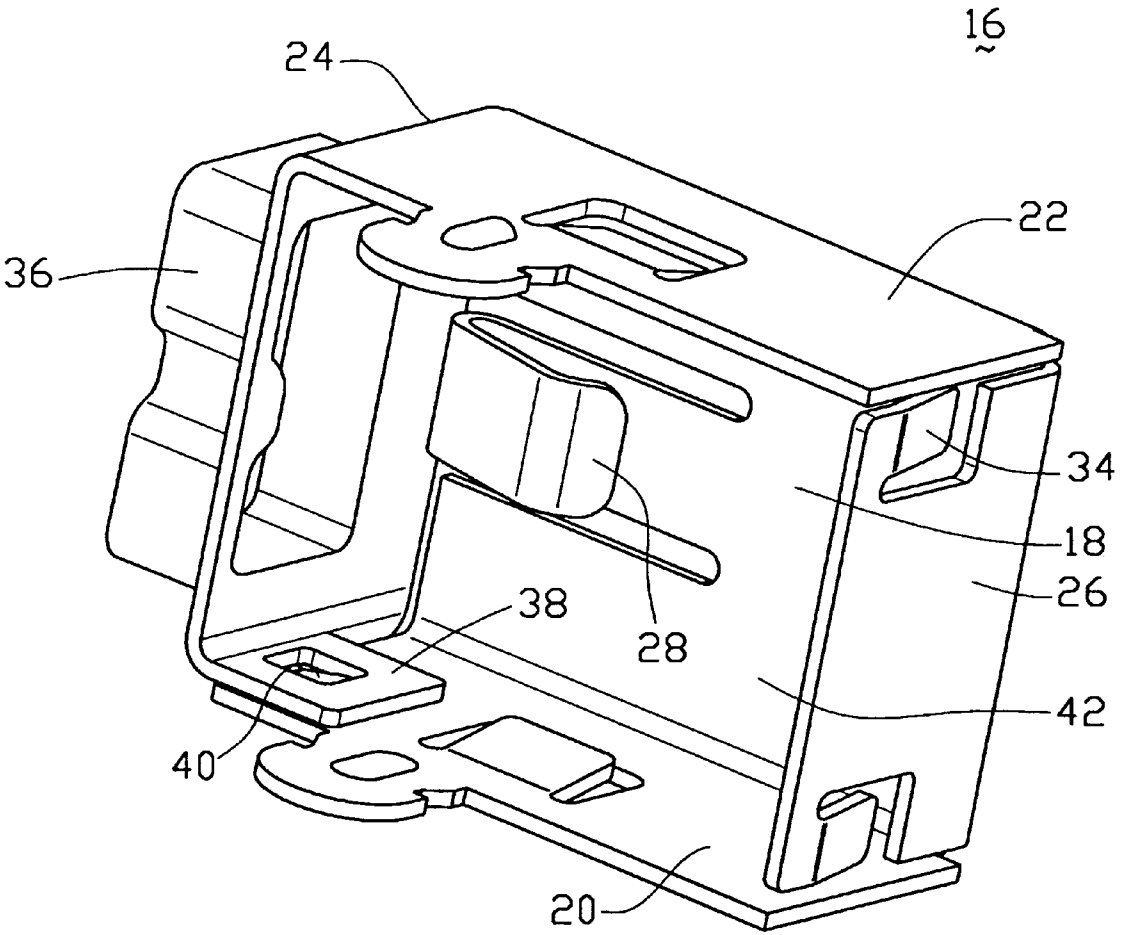
FIG. 4 is a bottom view of the conductive shield.

With reference to FIGS. 3 and 4, the shield 16 is integrally formed by stamping and comprises a top wall 18, a first side wall 22, a second side wall 20, a front wall 24 and a rear wall 26. The top wall 18, the first side wall 22, the second side wall 20 and the rear wall 26 are contiguously formed, and the front wall 24 is contiguously formed with the second side wall 20. Thus, a receiving cavity 42 is defined between the walls 18, 20, 22, 24, 26 for receiving the housing 12. A resilient spring contact 28 extends inwardly and rearwardly from the top wall 18 for engaging with a conductive shield of a mating connector (not shown) thereby constituting grounding protection. An inwardly bent first engaging piece 30 is formed on each side wall 20, 22 for securing the shield 16 to the housing 12. A board mount leg 32 downwardly extends from each side wall 20, 22 for mounting the shield 16 to a substrate board (not shown). A pair of inwardly bent second engagement pieces 34 is symmetrically formed on the rear wall 26 for engaging with the housing 12. An outer mating portion 36 is drawn from the front wall 24 outward. A tab 38 extends from the front wall 24 and defines a through hole (not labeled) therein for engaging with a corresponding fastening piece 40 inwardly extending from the first side wall 22. Thus, a fastening section for fastening the front wall 24 and the first side wall 22 together is defined with the tab 38 and the fastening piece 40.

Figure 5:
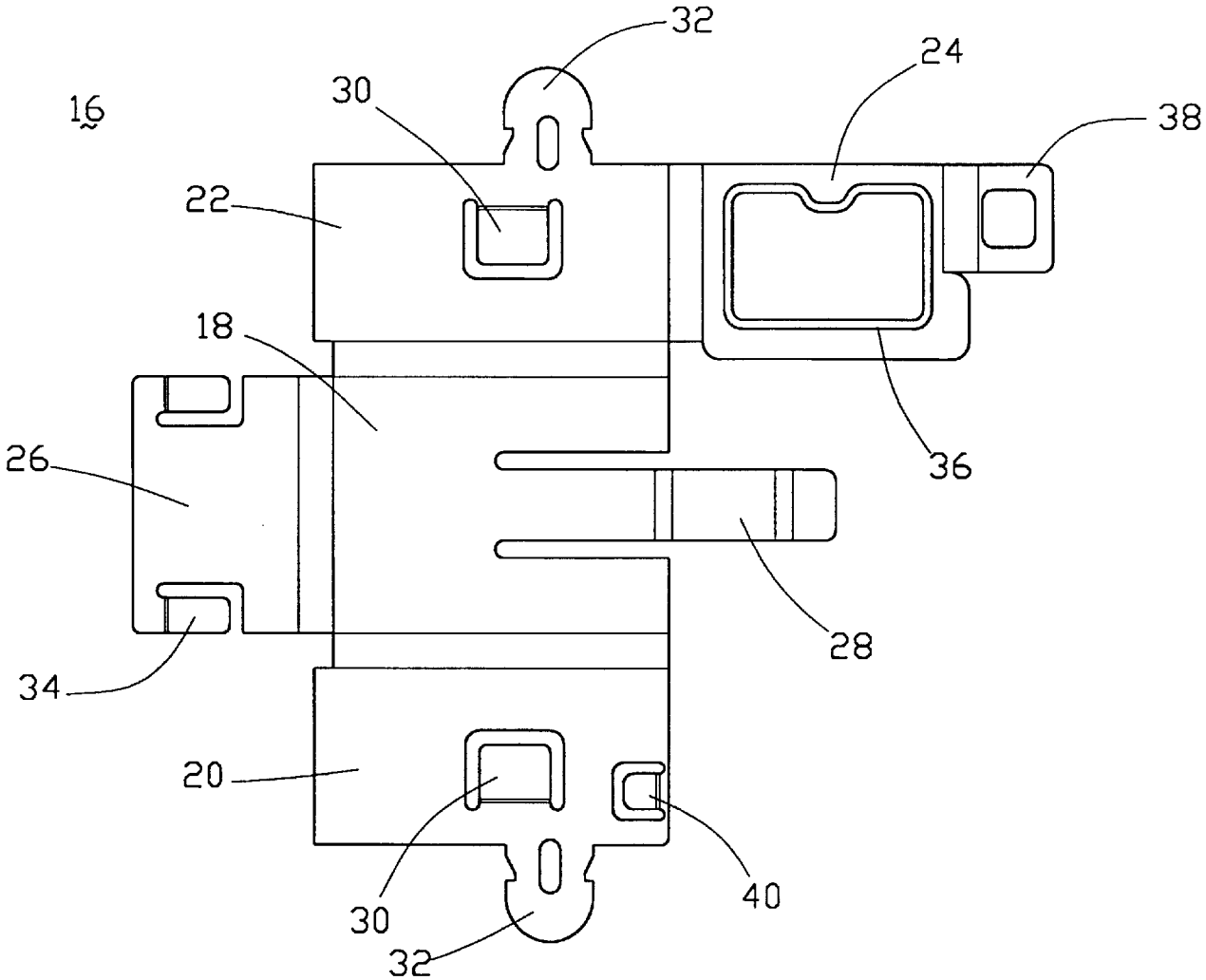
FIG. 5 is an outspread plan view of the conductive shield before a bending process is performed thereon.
Figure 6:
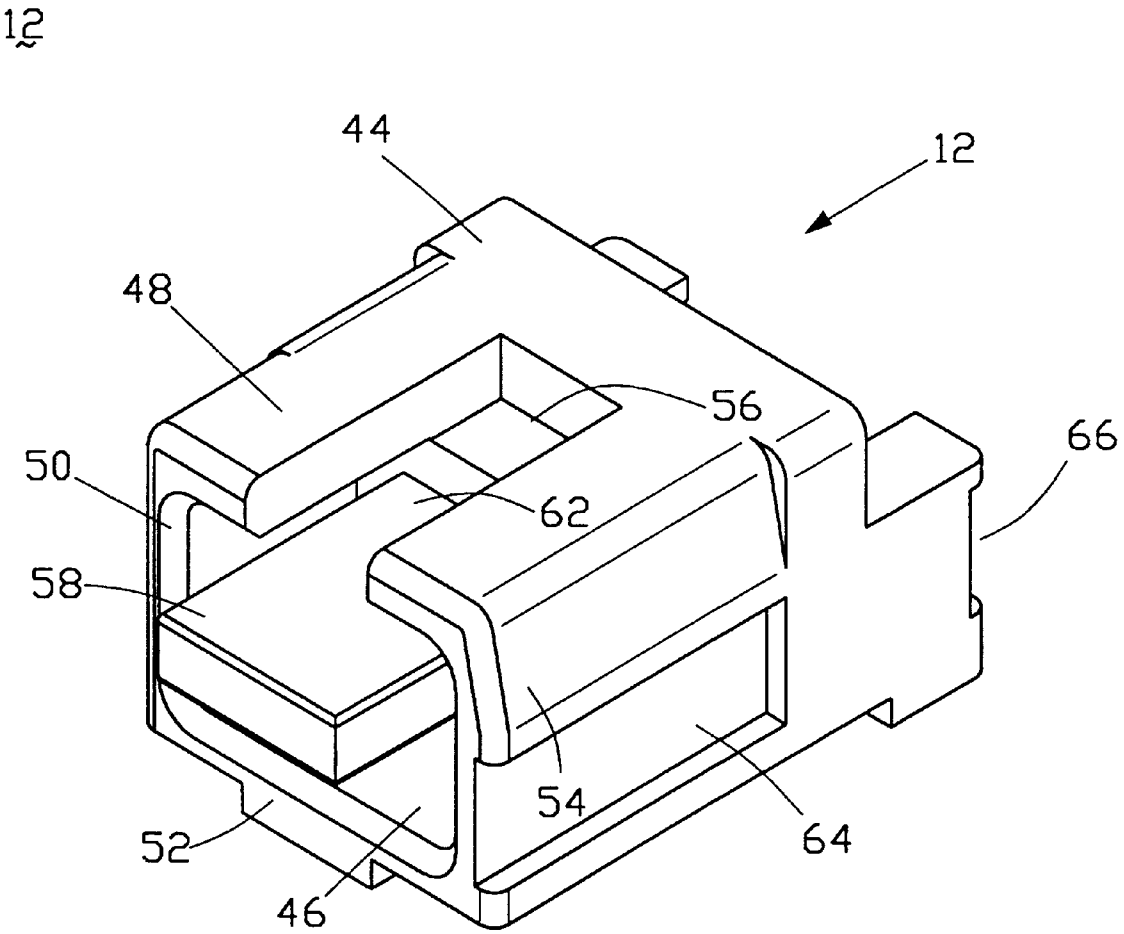
FIG. 6 is a perspective view of an insulative housing of the electrical connector.
Figure 7:
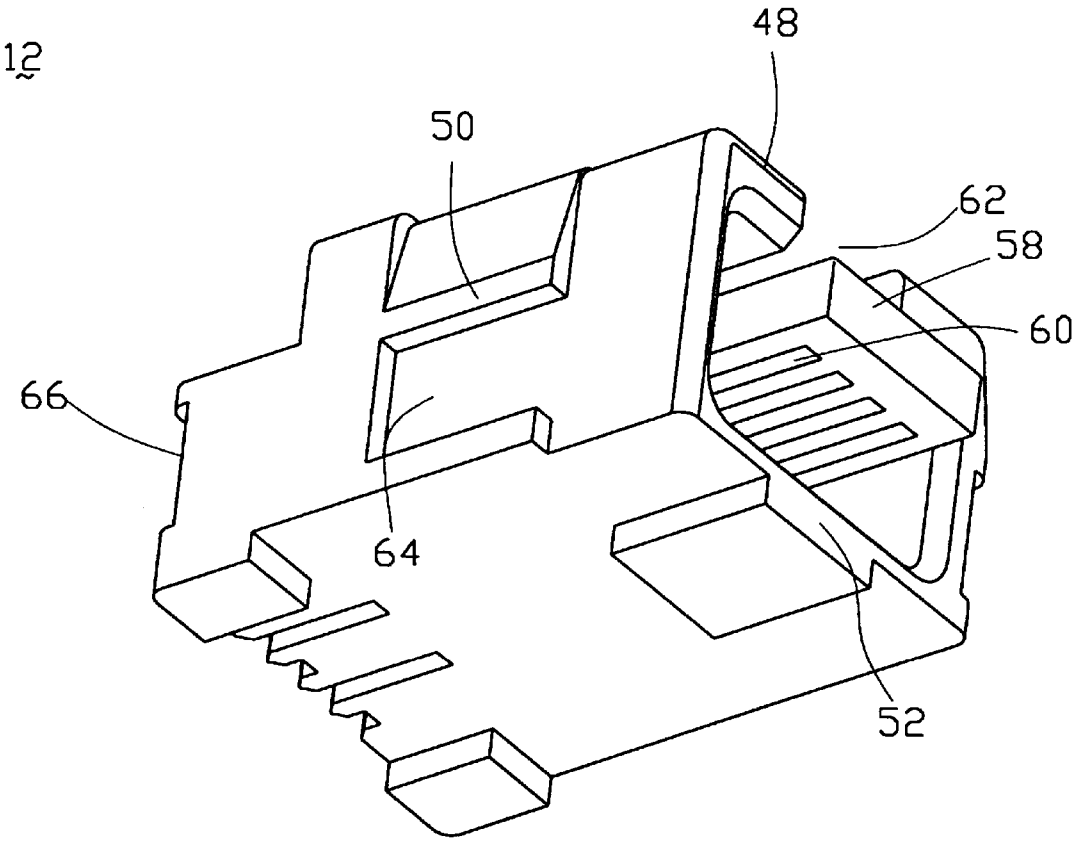
FIG. 7 is a bottom view of the insulative housing.

Also referring to FIG. 5, the front wall 24 borders the second side wall 20 along a lateral side thereof and is distanced from the other walls of the shield 16. A plurality of corners (not labeled) of the front wall 24 are arced to reduce the waste material from the manufacturing process, and to resist deformation of the front wall 24 during the process of drawing the outer mating portion 36. Also, the process of forming the other walls of the shield 16 is not interfered with each other, especially regarding the formation of the spring contact 28.

Referring to FIGS. 3, 4, 6 and 7, the housing 12 comprises a body 44 defining a cavity 46 for receiving a mating end of a mating connector (not shown). The cavity 46 is defined between a top insulative wall 48, a first insulative wall 50, a bottom insulative wall 52 and a second insulative wall 54. An inner mating end 58 extends from an inner surface 56 of the body 44 in a mating direction. A plurality of contact passageways 60 are defined in the body 44 and along a bottom surface of the inner mating end 58 for receiving corresponding contacts (not shown). A cutout 62 is formed in the top wall 48 for receiving the spring contact 28 of the shield 16. A recess 64 is formed on each first wall 50 and second wall 54 for engaging with the corresponding first engagement piece 30 of the shield 16. A pair of opposite grooves 66 is formed on a rear end of the housing 12 for engaging with the corresponding second engagement pieces 34 of the shield 16.

When the inserted mating end (not shown) of the mating connector cooperates with the inner mating end 58, the mating contacts (not shown) electrically engage therewith. The outer mating portion 36 of the shield 16 enshrouds a distal end of a shield (not shown) of the mating connector and the spring contact 28 firmly abuts against a corresponding portion of the mating shield to prevent displacement of the mating connector while providing grounding protection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shielded electrical connector comprising:

a unitary conductive shield having a plurality of walls defining a cavity therein;

an insulative housing engaged with and received in the conductive shield, the housing defining a plurality of contact passageways therein; and a plurality of contacts received in the corresponding contact passageways; wherein said shield includes at least a top wall a first side wall, and a front wall having a mating portion projecting therefrom for recieving a mating connector therethrough to mate with the contacts retained in the housing said first side wall integrally extending from the top wall, said front wall integrally extending from said first side wall while not directly connected to the top wall.

2. The shielded electrical connector as described in claim 1, wherein said mating portion of the shield integrally and outwardly projects from the front wall and is formed by drawing the front wall.

3. The shielded electrical connector as described in claim 2, wherein the shield further comprises a second side wall opposite to the first side wall, said second side wall being engaged with the front wall by means of a fastening section.

4. The shielded electrical connector as described in claim 3, wherein the fastening section comprises a tab extending from the front wall with a hole defined therein and a fastening piece formed on the second side wall engaging with the hole in the tab.

5. The shielded electrical connector as described in claim 1, wherein the shield comprises a rear wall for shielding a rear end of the housing.

6. The shielded electrical connector as described in claim 5, wherein:

the rear wall comprises an engagement piece; and the housing comprises a groove formed on a rear end thereof for engaging with the engagement piece to prevent upward movement of the shield with respect to the housing.

7. The shielded electrical connector as described in claim 1, wherein:

the shield comprises a resilient spring contact inwardly and rearwardly extending from a top wall thereof; and the housing comprises a cutout formed in a top insulative wall thereof for receiving the spring contact therein.

8. A shielded electrical connector comprising:

a unitary conductive shield having a plurality of walls defining a cavity therein;

an insulative housing engaged with and received within the conductive shield; and a plurality of contacts received within the housing;

said shield including a top wall, a first side wall a second side wall opposite to the first side wall, and a front wall, wherein said first and second side walls integrally extend from the top wall, the front wall integrally extends from the first side wall and is latchably secured to the second side wall while is not directly integrally connected to the top wall, and a resilient spring contact integrally and inwardly extends from one of said top wall and said front wall for engaging with a shield of a mating connector.

9. The connector as described in claim 8, wherein said resilient spring contact integrally extends from said top wall.

10. A shielded electrical connector comprising:

a unitary conductive shield having a plurality of walls defining a cavity therein;

an insulative housing engaged with the received within the conductive shield;

said shield including a top wall, a side wall extending downward from one side edge of the top wall, a front wall extending sideward from a front edge of the side wall while being not directly integrally connected to the top wall; wherein a circumferential mating portion forwardly extends from a middle portion of the front wall, and a resilient spring contact integrally extends rearwardly from a front edge of the top wall opposite to said mating portion.

* * * * *